US009181820B2

(12) United States Patent
Tani et al.

(10) Patent No.: US 9,181,820 B2
(45) Date of Patent: Nov. 10, 2015

(54) VALVE MECHANISM FOR INTERNAL COMBUSTION ENGINE AND CONTROL DEVICE FOR VALVE MECHANISM

(75) Inventors: Masaaki Tani, Toyota (JP); Fuminori Hosoda, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 14/396,499

(22) PCT Filed: Apr. 27, 2012

(86) PCT No.: PCT/JP2012/061380

§ 371 (c)(1),
(2), (4) Date: Nov. 21, 2014

(87) PCT Pub. No.: WO2013/161060

PCT Pub. Date: Oct. 31, 2013

(65) Prior Publication Data

US 2015/0090206 A1 Apr. 2, 2015

(51) Int. Cl.

| | |
|---|---|
| ***F01L 1/18*** | (2006.01) |
| ***F01L 1/24*** | (2006.01) |
| ***F01L 1/053*** | (2006.01) |
| ***F01L 13/00*** | (2006.01) |
| ***F01L 1/04*** | (2006.01) |

(52) U.S. Cl.

CPC ... *F01L 1/24* (2013.01); *F01L 1/04* (2013.01); *F01L 1/053* (2013.01); *F01L 1/185* (2013.01); *F01L 1/2405* (2013.01); *F01L 13/0021* (2013.01); *F01L 13/0031* (2013.01); *F01L 13/0005* (2013.01)

(58) Field of Classification Search

CPC ..... F01L 1/04; F01L 1/24; F01L 1/185; F01L 13/0005

USPC ..... 123/90.43, 90.44, 90.45

See application file for complete search history.

(56) References Cited

U.S. PATENT DOCUMENTS 7,225,776 B2 * 6/2007 Gecim ..... F01L 13/0031 123/90.39

FOREIGN PATENT DOCUMENTS

| | | |
|---|---|---|
| JP | A-2007-100585 | 4/2007 |
| JP | A-2007-146693 | 6/2007 |
| JP | A-2008-267332 | 11/2008 |
| JP | A-2008-286080 | 11/2008 |
| JP | A-2010-151147 | 7/2010 |
| JP | A-2010-168980 | 8/2010 |
| JP | A-2010-270701 | 12/2010 |

* cited by examiner

*Primary Examiner* — Ching Chang
(74) *Attorney, Agent, or Firm* — Oliff PLC

(57) ABSTRACT

A valve mechanism for an internal combustion engine is provided with a cam that rotates in conjunction with rotation of a crankshaft, an engine valve that is lifted and opened along with rotation of the cam, a variable lift amount mechanism that is arranged between the cam and the engine valve and varies the maximum amount of lift of the engine valve, and a lost motion mechanism that is arranged between the cam and the engine valve and absorbs the amount of lift of the engine valve by contracting when drive force is received from the cam to maintain a closed state of the engine valve. The maximum amount of contraction of the lost motion mechanism is set to such a value that the lost motion mechanism absorbs the minimum value of the maximum lift amount of the engine valve.

4 Claims, 7 Drawing Sheets

VALVE MECHANISM FOR INTERNAL COMBUSTION ENGINE AND CONTROL DEVICE FOR VALVE MECHANISM

TECHNICAL FIELD

The present invention relates to a valve mechanism for an internal combustion engine and a control device for controlling the valve mechanism.

BACKGROUND ART

In a valve mechanism for an internal combustion engine, the camshaft rotates in conjunction with the crankshaft when the crankshaft rotates. Rotation of the cam fixed to the camshaft lifts and opens the engine valve.

A valve mechanism for an internal combustion engine described in Patent Document 1 includes a lash adjuster for automatically adjusting the valve clearance of an engine valve, as illustrated in FIG. 10 of the document. The valve mechanism also includes a lost motion mechanism for maintaining the engine valve in a closed state independently from rotation of the cam.

The lost motion mechanism includes a lash adjuster, a housing shaped like a cylinder having a closed end for accommodating the lash adjuster, and a spring arranged in the housing to urge the lash adjuster toward the exterior. The housing and the body of the lash adjuster each have a hole. A lock pin is provided to extend through the holes to engage the housing and the lash adjuster with each other. A spring is provided to cause the lock pin to extend through the holes and urge the lock pin in an engagement direction, in which the housing and the lash adjuster become engaged with each other. A supply passage is also arranged to apply hydraulic pressure to an end face of the lock pin in the opposite direction to the engagement direction. A switch valve is arranged in the supply passage to switch supply modes of the hydraulic pressure.

Also, there is a control device for a valve mechanism that holds the engine valves of some or all of the cylinders of an engine in a (fully) closed state to stop intake and exhaust and stops fuel injection, thereby deactivating the cylinders.

In the above-described valve mechanism for an internal combustion engine, to perform cylinder deactivation, the switch valve applies hydraulic pressure to the end face of the lock pin through the supply passage to cancel the engagement state between the housing and the lash adjuster. This allows the lost motion mechanism to contract when the lost motion mechanism receives drive force from the cam. The lift amount of each engine valve is thus absorbed such that the engine valve is maintained in a closed state.

PRIOR ART DOCUMENTS

Patent Documents

Patent Document 1: Japanese Laid-Open Patent Publication No. 2008-267332

SUMMARY OF THE INVENTION

Problems that the Invention is to Solve

A valve mechanism for an internal combustion engine including a lost motion mechanism has the following drawbacks. To maintain an engine valve in a closed state to perform cylinder deactivation, the lost motion mechanism must contract by the amount corresponding to the lift amount of the engine valve. This increases the size of the lost motion mechanism in the contracting direction of the lost motion mechanism. Further, the lash adjuster, the spring, and the housing need to be arranged in series in the contracting direction. Accordingly, if the lash adjuster, the spring, and the housing are arranged in the cylinder head, the size of the cylinder head is enlarged.

To solve this problem, the lash adjuster and the other components may be arranged in an inclined manner to avoid enlargement of the size of the cylinder head. However, in this case, the basal end of the housing interferes with the intake port, the exhaust port, and the water jacket. As a result, if there is interference with the engine ports, the output performance of the internal combustion engine is decreased. If there is interference with the water jacket, the cooling performance is lowered.

Accordingly, it is an objective of the present invention to provide a valve mechanism for an internal combustion engine and a control device for the valve mechanism that are capable of preventing the size of the engine from being enlarged due to a lost motion mechanism.

Means for Solving the Problems

Means for achieving the above objective and advantages thereof will now be discussed.

To achieve the foregoing objective and in accordance with one aspect of the present invention, a valve mechanism for an internal combustion engine is provided that includes a cam that rotates in conjunction with rotation of an engine output shaft, an engine valve that is lifted and opened through rotation of the cam, a variable lift amount mechanism arranged between the cam and the engine valve to vary a maximum lift amount of the engine valve, and a lost motion mechanism arranged between the cam and the engine valve. The lost motion mechanism contracts when receiving drive force from the cam, thereby absorbing a lift amount of the engine valve to maintain the engine valve in a closed state. A maximum contraction amount of the lost motion mechanism is set to such a value that the lost motion mechanism absorbs a predetermined lift amount that is smaller than a maximum value of the maximum lift amount of the engine valve.

According to this configuration, when cylinder deactivation is performed, the lost motion mechanism receives drive force from the cam and thus contracts. This absorbs the lift amount of the engine valve, thus maintaining the engine valve in the closed state.

According to the configuration, compared with a configuration in which the maximum contraction amount of the lost motion mechanism is set to a value to absorb the maximum value of the maximum lift amount of the engine valve, the maximum contraction amount of the lost motion mechanism is small. Accordingly, the size of the lost motion mechanism in the contracting direction is reduced. As a result, according to the present invention, the size of the internal combustion engine is not enlarged due to the lost motion mechanism.

In this case, the predetermined lift amount is preferably set to a minimum value of the maximum lift amount of the engine valve.

According to this aspect, the maximum contraction amount of the lost motion mechanism is minimized. The size of the lost motion mechanism in the contracting direction is thus reliably reduced. As a result, the size of an internal combustion engine is reliably prevented from being enlarged due to the lost motion mechanism.

Also, it is preferable that the lost motion mechanism include a hydraulic lash adjuster arranged between the cam and the engine valve to automatically adjust a valve clearance of the engine valve, an urging member capable of contracting when the lash adjuster receives drive force from the cam, and a switch portion for switching the lost motion mechanism between a permitting state for permitting contraction of the urging member and a prohibiting state for prohibiting the contraction, wherein the switch portion switches the lost motion mechanism to the permitting state when the lost motion mechanism maintains the engine valve in the closed state.

According to this aspect, in an engine operating state in which cylinder deactivation is not performed, the switch portion switches the lost motion mechanism to the prohibiting state for prohibiting contraction of the urging member. The urging member thus does not contract when the lash adjuster receives drive force from the cam. This allows the lash adjuster to automatically adjust the valve clearance of the engine valve.

In contrast, when cylinder deactivation is performed, the switch portion switches the lost motion mechanism to the permitting state for permitting the contraction of the urging member. The urging member thus contracts when the lash adjuster receives drive force from the cam. This absorbs the lift amount of the engine valve to maintain the engine valve in the closed state. As a result, a lost motion mechanism according to the present invention is embodied in a preferable manner.

In this case, the lost motion mechanism preferably includes a housing shaped like a cylinder having a closed end, the housing accommodating the lash adjuster in a slidable manner, an engagement member capable of engaging the housing and the lash adjuster with each other, and a supply passage that applies hydraulic pressure to the engagement member such that the hydraulic pressure acts on the engagement member in a direction for cancelling an engagement state between the housing and the lash adjuster. The switch portion is preferably a switch valve provided in the supply passage to switch supply modes of the hydraulic pressure to the engagement member.

Also, a control device for controlling the above described valve mechanism for an internal combustion engine preferably includes a control section that controls the maximum lift amount of the engine valve to a value smaller than or equal to the predetermined lift amount when cylinder deactivation is performed in the internal combustion engine.

According to this aspect, to perform cylinder deactivation, the maximum lift amount of the engine valve is controlled to a value smaller than or equal to the predetermined lift amount, which is smaller than the maximum lift amount. This allows the lost motion mechanism to reliably maintain the engine valve in the closed state.

MODES FOR CARRYING OUT THE INVENTION

One embodiment of the present invention as a DOHC type valve mechanism and a control device for the valve mechanism will now be described with reference to FIGS. 1 to 7.

A drive system for selectively opening and closing an intake valve and a drive system for selectively opening and closing an exhaust valve are configured basically identical with each other. Accordingly, the description below is focused on the configuration of the drive system for an intake valve (hereinafter, an engine valve) and description of the configuration of the drive system for an exhaust valve is omitted herein.

Figure 1:
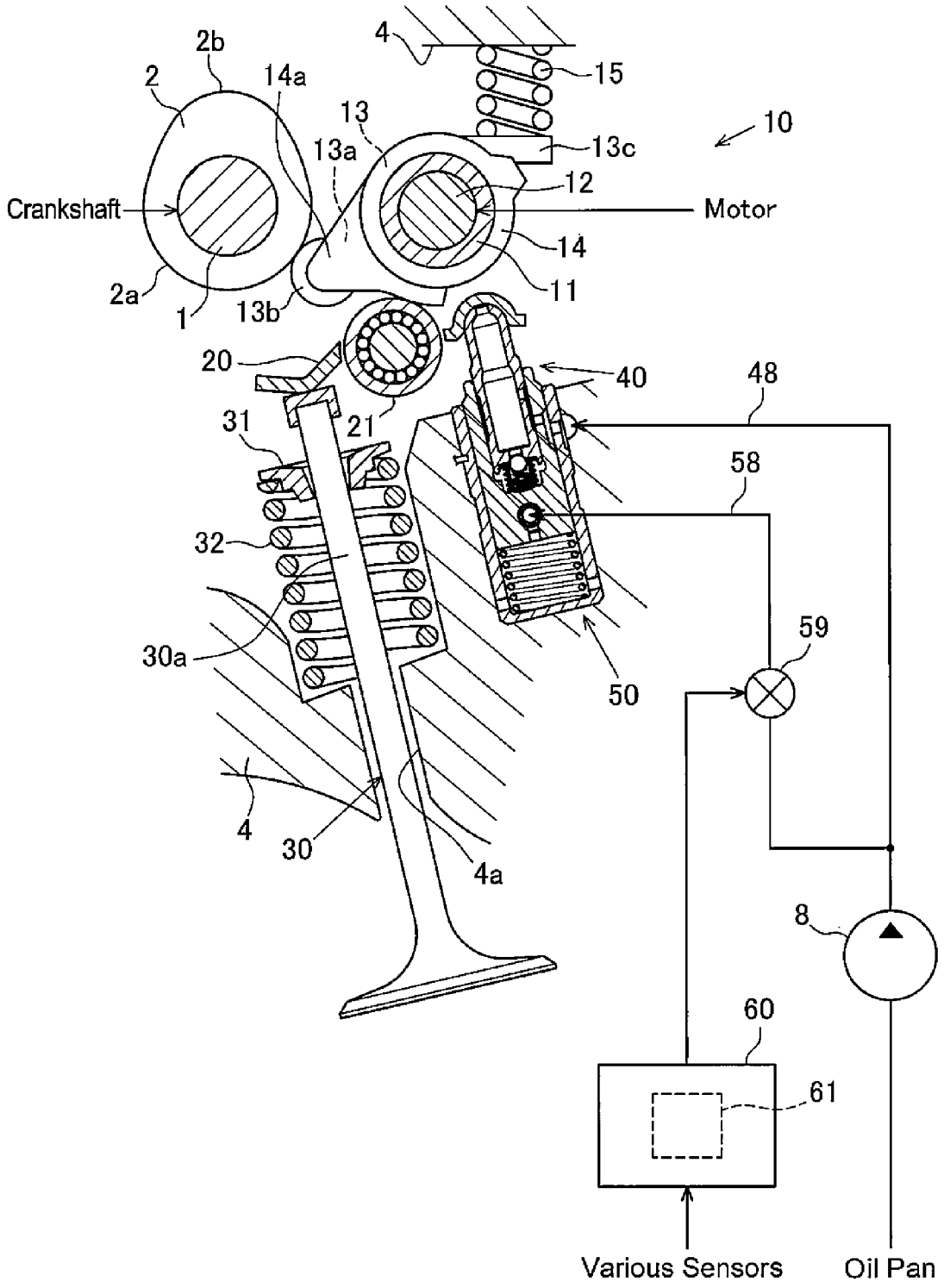
FIG. 1 is a cross-sectional view showing the cross-section structure of a valve mechanism for an internal combustion engine according to one embodiment of the present invention.

As illustrated in FIG. 1, a valve mechanism includes a camshaft 1, which rotates in conjunction with rotation of a crankshaft. A cam 2 is fixed to the camshaft 1. A base circle 2*a* and a cam nose 2*b*, which projects radially outward from the base circle 2*a*, are formed in the cam 2. When the cam 2 rotates, a variable lift amount mechanism 10 and a roller rocker arm 20 are operated to lift and open an engine valve 30.

The engine valve 30 is a poppet valve and has a stem portion 30*a*, which is received in a guide hole 4*a* extending through a cylinder head 4. A retainer 31 is attached to the stem portion 30*a*. A valve spring 32 is arranged between the retainer 31 and the cylinder head 4 to constantly urge the engine valve 30 in a closing direction. A distal end of the stem portion 30*a* is held in contact with a basal end portion of the roller rocker arm 20.

The variable lift amount mechanism 10, which is publicly known, is arranged between the cam 2 and the engine valve 30 to vary a maximum lift amount Lmax of the engine valve 30.

The variable lift amount mechanism 10 includes a support pipe 11, a control shaft 12, an input portion 13, an output portion 14, and a slider gear (not shown), which are arranged coaxially.

The control shaft 12 is arranged in a manner movable in the support pipe 11 in the axial direction of the support pipe 11 (in a direction perpendicular to the sheet surface of FIG. 1). The control shaft 12 is driven by a motor. A conversion mechanism (not shown) for converting rotation of the motor into linear movement is provided between the control shaft 12 and the motor.

The input portion 13 has a substantially cylindrical shape and is arranged around the support pipe 11. Helical-spline-like teeth are formed in an inner circumferential surface of the input portion 13. An input arm 13*a* is arranged on an outer circumferential surface of the input portion 13. A roller 13*b*, which receives drive force from the cam 2, is rotationally arranged in the input arm 13*a*. A projecting piece 13*c* projects from the outer circumferential surface of the input portion 13. A spring 15 is arranged between the projecting piece 13*c* and the cylinder head 4. The spring 15 urges the input portion 13 clockwise as viewed in the drawing so that the roller 13*b* and the cam 2 are maintained in contact with each other.

The output portion 14 has a substantially cylindrical shape and is arranged around the support pipe 11. Helical-spline-like teeth, which are inclined in the opposite direction to the inclining direction of the helical-spline-like teeth formed in the inner circumferential surface of the input portion 13, are formed in an inner circumferential surface of the output portion 14. An output arm 14*a*, which transmits drive force to a roller 21 of the roller rocker arm 20, is formed in an outer circumferential surface of the output portion 14.

A slider gear is arranged between the support pipe 11 and the input portion 13 and the output portion 14. Helical-spline-like teeth meshed with the teeth of the input portion 13 and helical-spline-like teeth meshed with the teeth of the output portion 14 are formed in an outer circumferential surface of the slider gear. The slider gear is engaged with the control shaft 12 in a manner movable in conjunction with movement of the control shaft 12 in the aforementioned axial direction.

In the variable lift amount mechanism 10, when the motor drives the control shaft 12 to move in the aforementioned axial direction, the slider gear rotates and moves in the axial direction between the input portion 13 and the output portion 14. At this stage, the teeth of the input portion 13 and the teeth of the output portion 14 are meshed with the teeth of the slider gear. Accordingly, as the slider gear moves, the input portion 13 and the output portion 14 rotate relative to each other in the opposite directions. This varies the maximum lift amount Lmax of the engine valve 30 in correspondence with the position of the control shaft 12 in the aforementioned axial direction.

Figure 2:
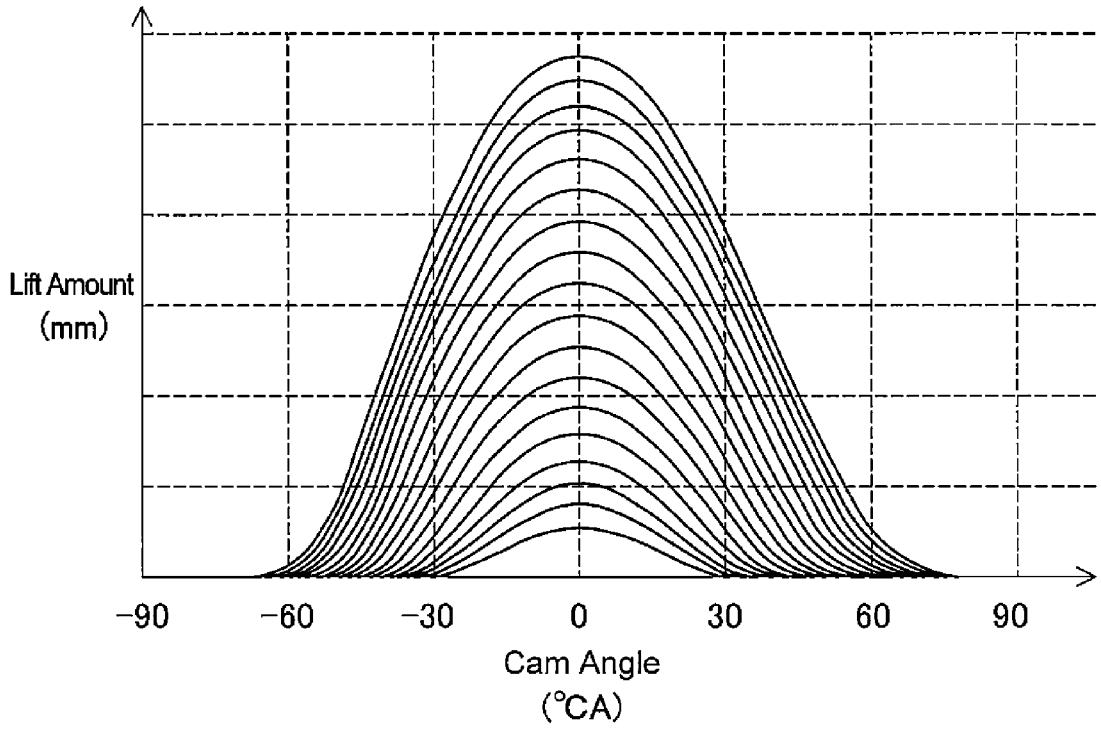
FIG. 2 is a graph representing lift patterns of an engine valve of the embodiment for different maximum lift amounts.

With reference to FIG. 2, the minimum value of the maximum lift amount Lmax brought about by the variable lift amount mechanism 10 is set to 1 mm and the maximum value of the maximum lift amount Lmax is set to 11 mm.

In the present embodiment, the variable lift amount mechanism 10 is configured in a publicly known manner, as described in, for example, Japanese Laid-Open Patent Publication No. 2010-151147.

A distal end of the roller rocker arm 20 is supported by the lost motion mechanism 50 having a lash adjuster 40.

Figure 3A:
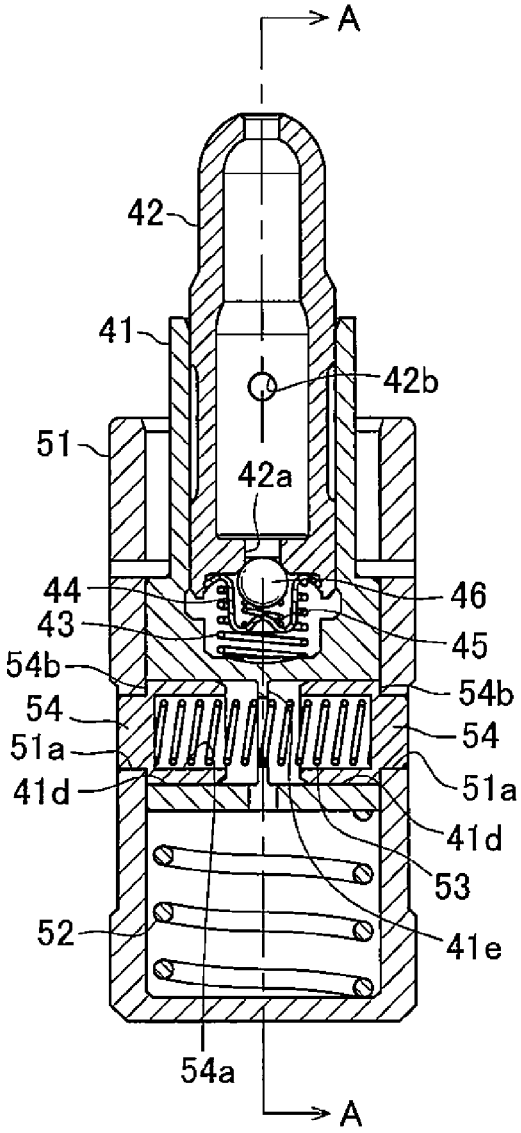
FIG. 3A is a cross-sectional view showing the cross-section structure of a lost motion mechanism including a lash adjuster according to the embodiment.
Figure 3B:
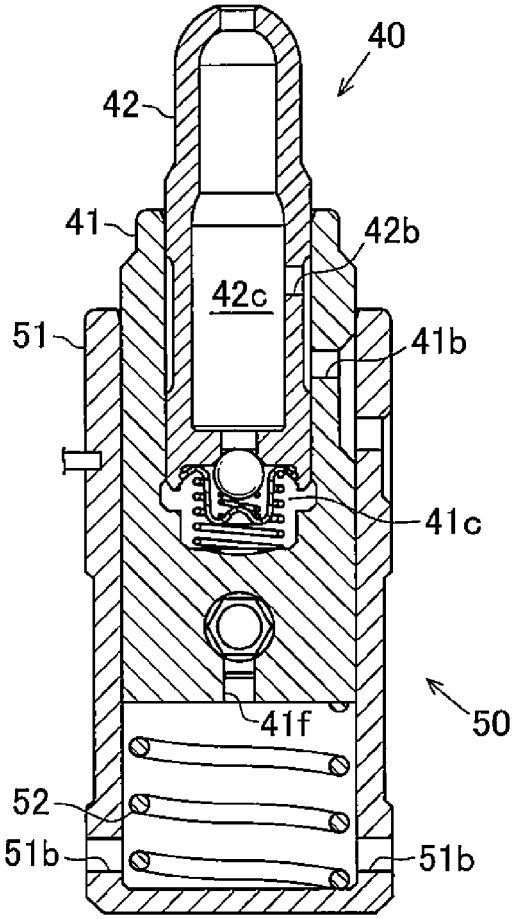
FIG. 3B is a cross sectional view taken along line A-A of FIG. 3A, showing the cross-section structure of the lost motion mechanism.

The configuration of the lost motion mechanism 50, which includes the lash adjuster 40, will hereafter be described with reference to FIG. 3. FIG. 3A is a cross-sectional view showing the cross-section structure of the lost motion mechanism 50. FIG. 3B is a cross-sectional view showing the cross-section structure taken along line A-A of FIG. 3A.

As illustrated in FIGS. 3A and 3B, the lash adjuster 40 automatically adjusts the valve clearance of the engine valve 30. The lash adjuster 40 is a pivot type and includes a body 41 shaped like a cylinder having a closed end. A hollow plunger 42 is arranged in the body 41 in a manner slidable in the axial direction of the body 41. A communication hole 42*a* is formed in the bottom of the plunger 42. An inlet hole 41*b* and an inlet hole 42*b* are formed in a side portion of the body 41 and a side portion of the plunger 42, respectively.

The inlet holes 41*b*, 42*b* receive hydraulic pressure from an oil pump 8 via a first supply passage 48, which is shown in FIG. 1. The portion of the outer circumferential surface of the plunger 42 including the inlet hole 42*b* has a reduced diameter along the entire circumference. This maintains the inlet holes 41*b*, 42*b* in a connected state even when movement of the plunger 42 causes the position of the inlet hole 42*b* and the position of the inlet hole 41*b* to become offset from each other.

A plunger spring 43 is arranged between the bottom surface of the body 41 and the plunger 42 to constantly urge the plunger 42 outward.

More specifically, a ball retainer 44 is provided on the surface of the plunger 42 facing the bottom surface of the body 41. A check ball 46 capable of closing the communication hole 42*a* and a ball spring 45 for constantly urging the check ball 46 toward the communication hole 42*a* are arranged between the ball retainer 44 and the plunger 42. The plunger spring 43 is pressed against and held in contact with the ball retainer 44 and urges the plunger 42 to the exterior through the ball retainer 44.

The space defined by the bottom surface of the body 41 and the plunger 42 is referred to as a first chamber 41*c*. The interior of the plunger 42 is referred to as a second chamber 42*c*.

An insertion hole 41*d* extends through a basal end portion of the body 41 in a radial direction of the body 41. A communication hole 41*f*, which communicates with insertion holes 41*d*, is formed at the center of the bottom surface of the body 41 and extends in the axial direction of the body 41.

A portion of the body 41 of the lash adjuster 40 is received in a housing 51, which is formed like a cylinder having a closed end. The lash adjuster 40 is arranged in the housing 51 in a manner slidable in the axial direction of the housing 51. The housing 51 is arranged in the cylinder head 4 (see FIG. 1).

A lost motion spring 52 is arranged between the bottom surface of the housing 51 and the body 41 to urge the body 41 outward.

A pair of engagement holes 51*a* is formed in a side portion of the housing 51 and arranged at positions facing each other with the axis of the housing 51 in between.

A pin 54 is inserted in each engagement hole 51*a* and the corresponding one of the insertion holes 41*d* of the body 41. A recess 54*a* is formed in an inner end face of each lock pin 54. A lock spring 53 is arranged between the recesses 54*a* in a pressed state. A stepped portion 54*b* is formed in the outer circumferential surface of each lock pin 54 and contacts a circumferential portion of the corresponding engagement hole 51*a* to restrict outward displacement of the lock pin 54.

A projection 41*e* is formed in an inner wall of each of the insertion holes 41*d* of the body 41 to restrict inward displacement of the lock pins 54, such that interference between the lock pins 54 is avoided.

Hydraulic pressure is applied to an outer end face of each lock pin 54 from the oil pump 8 through a second supply passage 58, which is shown in FIG. 1. A switch valve 59 is arranged in the second supply passage 58 to switch supply modes of the hydraulic pressure. The switch valve 59 is an electromagnetic valve.

A pair of outlet holes 51*b* is formed in a side portion of the housing 51 at the basal end and arranged at positions facing each other with the axis of the housing 51 in between. Oil leaking from the gap between each insertion hole 41*d* and the corresponding lock pin 54 is sent to the space between the bottom surface of the housing 51 and the body 41 via the communication hole 41*f*. The oil is then discharged into an outlet passage (not shown) formed in the cylinder head 4 through the two outlet holes 51*b*.

In the present embodiment, a maximum contraction amount X of the lost motion mechanism 50 is set to a value that absorbs the minimum value of the maximum lift amount Lmax of the engine valve 30 (in the present embodiment, 1 mm). In other words, in the lost motion mechanism 50, when the maximum lift amount Lmax of the engine valve 30 is greater than the minimum value, the engine valve 30 cannot be maintained in a closed state even if the lost motion spring 52 maximally contracts.

Operation modes of the lost motion mechanism 50 will hereafter be described with reference to FIGS. 4 and 5.

Figure 4B:
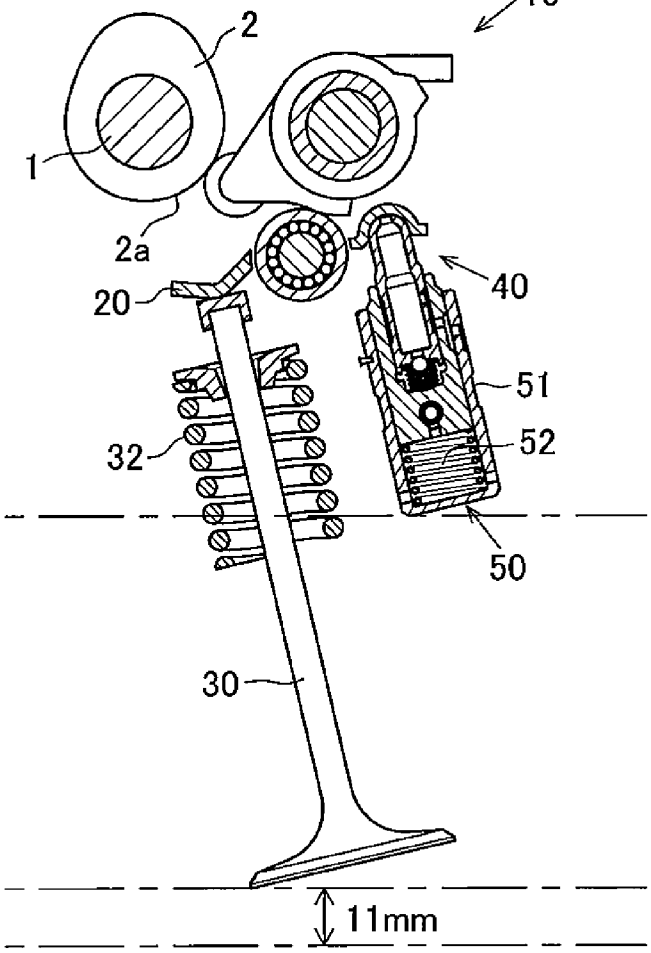
FIG. 4B is a cross-sectional view showing a state where the maximum lift amount of the engine valve is the maximum value and the engine valve is fully closed by the base circle of the cam.
Figure 4A:
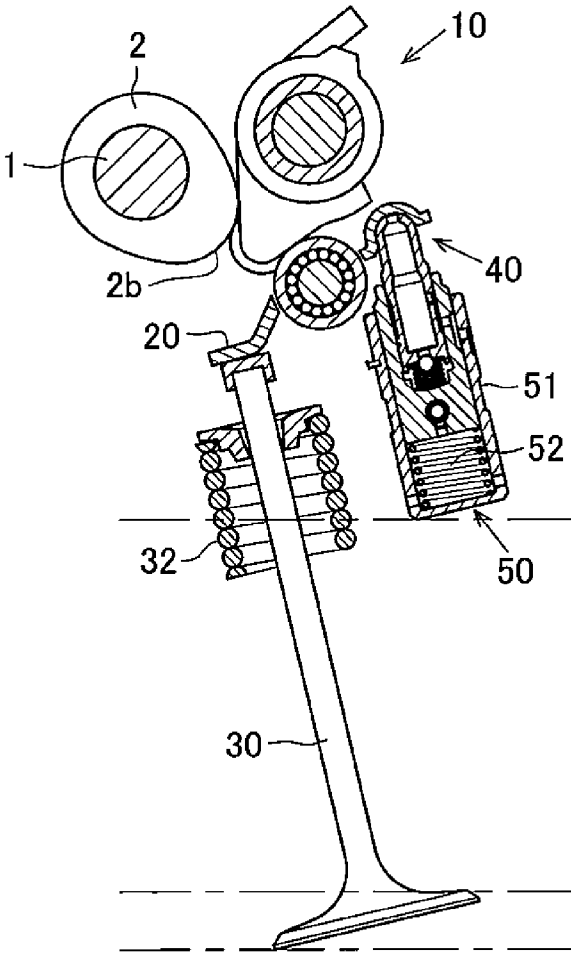
FIG. 4A is a cross-sectional view showing the cross-section structure of the valve mechanism for an internal combustion engine according to the embodiment in a state where the maximum lift amount of the engine valve is a maximum value and the engine valve is fully open.

FIG. 4A is a cross-sectional view showing the cross-section structure of the valve mechanism for an internal combustion engine in a state where the maximum lift amount Lmax of the engine valve 30 is the maximum value and the engine valve 30 is fully open. FIG. 4B is a cross-sectional view showing the cross-section structure of the valve mechanism for an internal combustion engine in a state where the maximum lift amount Lmax of the engine valve 30 is the maximum value and the engine valve 30 is fully closed by the base circle 2*a* of the cam 2.

Figure 5B:
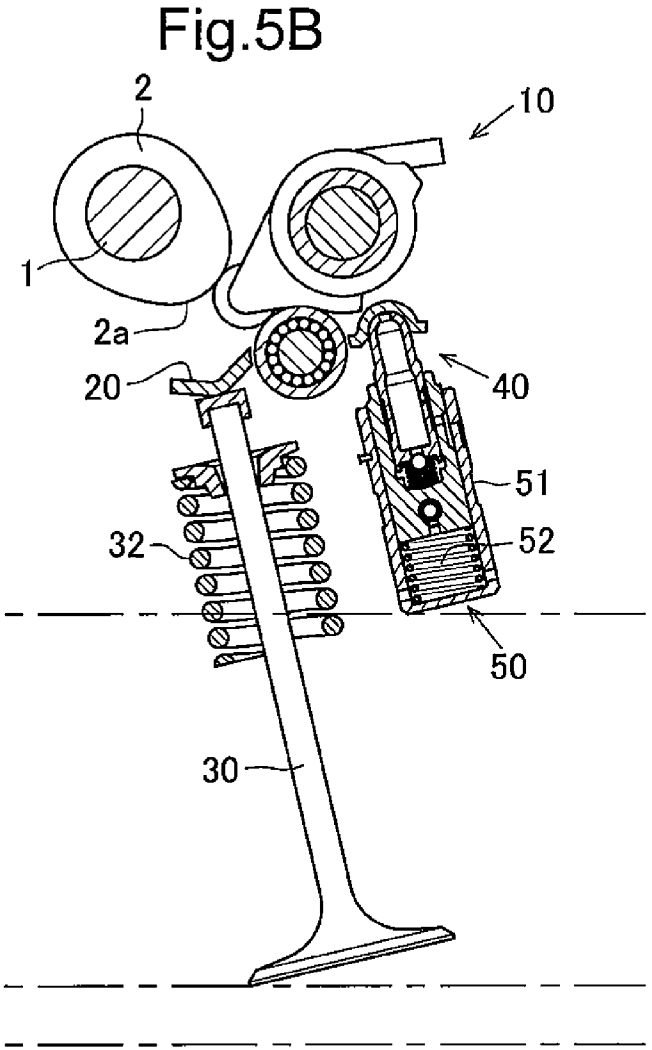
FIG. 5B is a cross-sectional view showing a state where the maximum lift amount of the engine valve is the minimum value and the engine valve is maintained in a fully closed state by the lost motion mechanism.
Figure 5A:
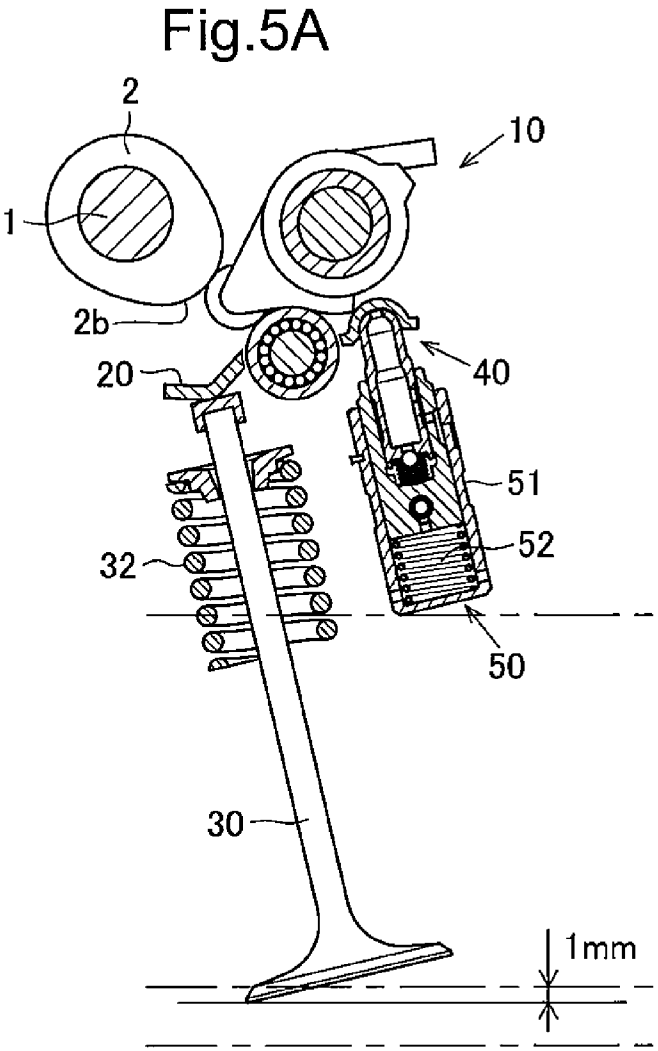
FIG. 5A is a cross-sectional view showing the cross-section structure of the valve mechanism for an internal combustion engine according to the embodiment in a state where the maximum lift amount of the engine valve is a minimum value and the engine valve is fully open.

FIG. 5A is a cross-sectional view showing the cross-section structure of the valve mechanism for an internal combustion engine in a state where the maximum lift amount Lmax of the engine valve 30 is the minimum value and the engine valve 30 is fully open. FIG. 5B is a cross-sectional view showing the cross-section structure of the valve mechanism for an internal combustion engine in a state where the maximum lift amount Lmax of the engine valve 30 is the minimum value and the engine valve 30 is maintained in a fully closed state by the lost motion mechanism 50.

When the internal combustion engine is in a high-load operating state, for example, and the maximum lift amount Lmax of the engine valve 30 is set to the maximum value (in this case, 11 mm) by the variable lift amount mechanism 10 as represented in FIGS. 4A and 4B, the switch valve 59 is held in a closed state. This causes the lock pins 54 to maintain the housing 51 and the body 41 in an engagement state. The lost motion mechanism 50 is thus held in a prohibiting state for prohibiting contraction of the lost motion spring 52. As a result, the lost motion spring 52 does not contract when the lash adjuster 40 receives drive force from the cam 2. The lash adjuster 40 thus automatically adjusts valve clearance of the engine valve 30.

In contrast, to perform cylinder deactivation when the internal combustion engine is in an idle operating state or a low-load operating state, for example, and the maximum lift amount Lmax of the engine valve 30 is the minimum value as represented in FIG. 5A, the switch valve 59 is opened to apply hydraulic pressure onto the lock pins 54 through the second supply passage 58. The lock pins 54 are displaced inward into the housing 51 against the urging force of the lock spring 53. This cancels the engagement state between the housing 51 and the body 41 by the lock pins 54. Accordingly, with reference to FIG. 5B, the lost motion spring 52 contracts when the plunger 42 of the lash adjuster 40 receives the drive force transmitted from the cam 2 to the variable lift amount mechanism 10 and the roller rocker arm 20. That is, by opening the switch valve 59, the lost motion mechanism 50 is switched to a permitting state for permitting contraction of the lost motion spring 52. Since the lost motion spring 52 contracts in this manner, the engine valve 30 is not lifted by the roller rocker arm 20 and the lift amount L of the engine valve 30 is absorbed. The engine valve 30 is thus maintained in a closed state.

As illustrated in FIG. 1, an electronic control unit 60 performs various types of control on the internal combustion engine. The electronic control unit 60 includes a central processing unit (CPU) for carrying out calculation procedures related to the various types of control, a read only memory (ROM) for storing programs and data for the control, and a random access memory (RAM) for temporarily storing results of the calculation procedures. The electronic control unit 20 reads detection signals from various types of sensors, executes the calculation procedures, and controls the engine based on the obtained results in a centralized manner.

The various types of sensors, through which the engine operating state is determined, are connected to the electronic control unit 60.

The electronic control unit 60 includes a control section 61 for performing variation control of the maximum lift amount Lmax of the engine valve 30 by means of the variable lift amount mechanism 10 and cylinder deactivation control by means of the lost motion mechanism 50.

To perform cylinder deactivation, the control section 61 controls the maximum lift amount Lmax of the engine valve 30 to the minimum value.

Steps of executing the cylinder deactivation control will hereafter be described with reference to the flowchart of FIG. 6. A series of procedure represented in FIG. 6 is repeatedly performed by the electronic control unit 60 at predetermined time intervals when the electronic control unit 60 receives electricity.

Figure 6:
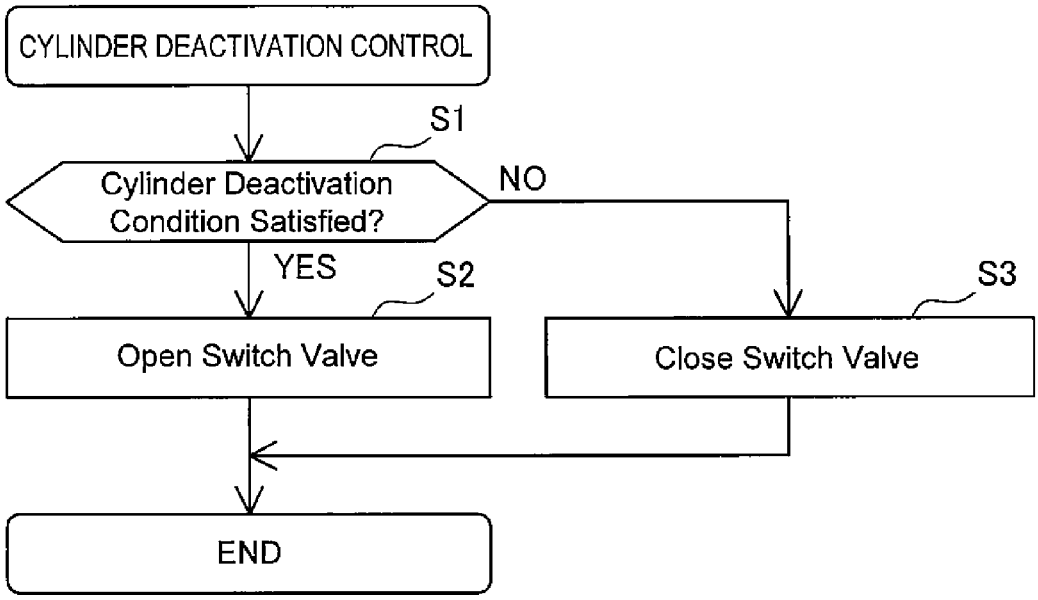
FIG. 6 is a flowchart representing steps of performing cylinder deactivation control according to the embodiment.

Referring to FIG. 6, in the series of procedure, it is first determined whether a cylinder deactivation condition is satisfied in step S1. The cylinder deactivation condition is satisfied if the internal combustion engine is in a low-load operating state or an idle operating state, for example, and the maximum lift amount Lmax of the engine valve 30 is the minimum value.

If the cylinder deactivation condition is not satisfied (step S1: "NO"), such as when the internal combustion engine is in a high-load operating state or when the engine is in a low-load operating state but the maximum lift amount Lmax of the engine valve 30 is not the minimum value, it is determined that the cylinder deactivation should not be performed at the current timing and step S3 is carried out. The switch valve 59 is thus closed (or maintained in the closed state if the switch valve 59 is already closed) and the series of procedure is suspended.

In contrast, when the cylinder deactivation condition is satisfied (step S1: "YES"), step S2 is performed. The switch valve 59 is thus opened and the series of procedure is suspended.

Operation of the present embodiment will hereafter be described with reference to FIG. 7.

Figure 7A:
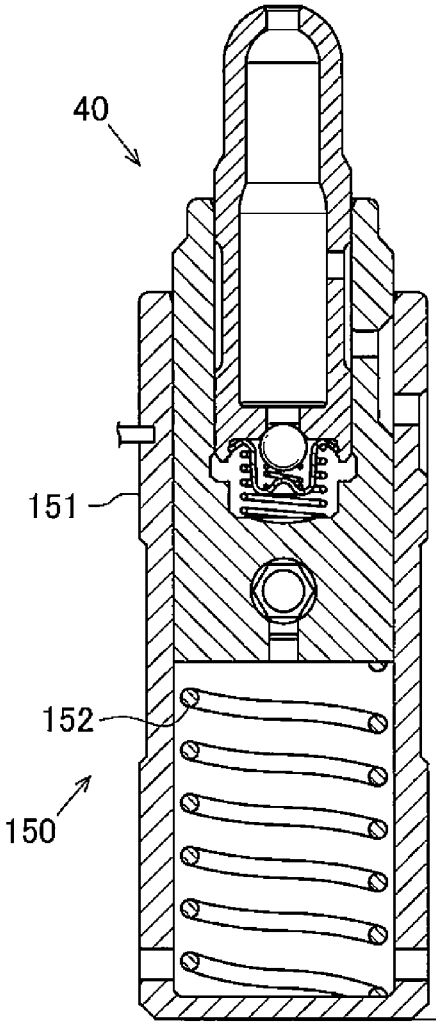
FIG. 7A is a cross-sectional view showing the cross-section structure of a lost motion mechanism of a comparative example.
Figure 7B:
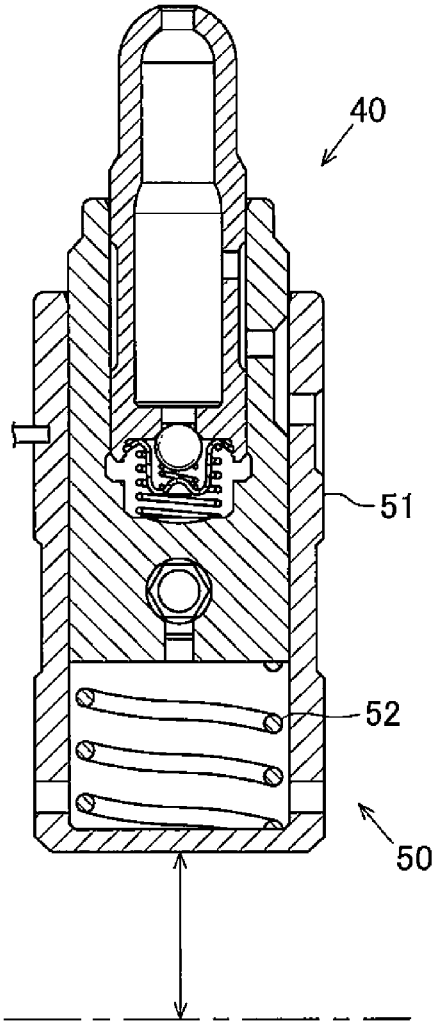
FIG. 7B is a cross-sectional view showing the cross-section structure of the lost motion mechanism according to the embodiment.

FIG. 7A is a cross-sectional view showing the cross-section structure of a conventional lost motion mechanism 150 as a comparative example. FIG. 7B is a cross-sectional view showing the cross-section structure of the lost motion mechanism 50 according to the present embodiment. The lost motion mechanism 150 as the comparative example is different from the embodiment in that the length of the lost motion mechanism 150 in the axial direction of a housing 151 and the length of a lost motion spring 152 are comparatively great. However, a lash adjuster 40 is configured identically with that of the embodiment.

As illustrated in FIG. 7A, the maximum contraction amount of the lost motion mechanism 150 as the comparative example is set to a value that absorbs the maximum value of the maximum lift amount of an engine valve.

In contrast, with reference to FIG. 7B, the maximum contraction amount X of the lost motion mechanism 50 of the present embodiment is set to a value that absorbs the minimum value of the maximum lift amount Lmax of the engine valve 30. The maximum contraction amount X is thus small compared with the maximum contraction amount of the lost motion mechanism 150 as the comparative example. This reduces the size of the lost motion mechanism 50 in the axial direction of the housing 51, or, in other words, the contracting direction of the lost motion mechanism 50.

The valve mechanism for an internal combustion engine and a control device for the valve mechanism of the present embodiment, which have been described, have the advantages described below.

(1) The valve mechanism for an internal combustion engine includes the variable lift amount mechanism 10 and the lost motion mechanism 50. The variable lift amount mechanism 10 is arranged between the cam 2 and the engine valve 30 to vary the maximum lift amount Lmax of the engine valve 30. The lost motion mechanism 50 is provided between the cam 2 and the engine valve 30 and contracts when receiving drive force from the cam 2 to absorb the lift amount L of the engine valve 30, thus maintaining the engine valve 30 in a closed state. The maximum contraction amount X of the lost motion mechanism 50 is set to a value that absorbs the minimum value of the maximum lift amount Lmax of the engine valve 30. This configuration reliably prevents the size of the internal combustion engine from being enlarged due to the lost motion mechanism 50.

(2) The valve mechanism for an internal combustion engine includes the hydraulic lash adjuster 40, which is arranged between the cam 2 and the engine valve 30 to automatically adjust the valve clearance of the engine valve 30. The lost motion mechanism 50 includes the lost motion spring 52 and the switch valve 59. The lost motion spring 52 is capable of contracting when the lash adjuster 40 receives drive force from the cam 2. The switch valve 59 switches the lost motion mechanism 50 between the permitting state for permitting contraction of the lost motion spring 52 and the prohibiting state for prohibiting the contraction of the lost motion spring 52. The switch valve 59 switches the lost motion mechanism 50 to the permitting state when the engine valve 30 is maintained in a closed state. In this configuration, the lost motion mechanism 50 is embodied in a preferable manner.

(3) The electronic control unit 60 includes the control section 61, which controls the maximum lift amount Lmax of the engine valve 30 to the minimum value when cylinder deactivation is performed. In this configuration, when the cylinder deactivation is performed, the maximum lift amount Lmax of the engine valve 30 is controlled to the minimum value. This allows the lost motion mechanism 50 to reliably maintain the engine valve 30 in a closed state.

The valve mechanism for an internal combustion engine and the control device for the valve mechanism according to the present invention are not restricted to the configurations of the above illustrated embodiment but may be embodied in the forms described below, for example, which are modifications of the configurations of the embodiment.

In the above illustrated embodiment, the housing 51 and the body 41 are engaged with each other by means of the lock pins 54. The engagement state between the housing 51 and the body 41 is canceled by applying hydraulic pressure to the lock pins 54 via the second supply passage 58. However, the manner of engaging the housing and the body with each other and the manner of canceling such engagement may be modified.

In the above illustrated embodiment, the configuration in which drive force is transmitted from the cam 2 to the lash adjuster 40 through the roller rocker arm 20 has been described by way of example. However, instead of the roller rocker arm 20, a simple rocker arm without a roller may be employed.

The configuration of the variable lift amount mechanism is not restricted to the configuration of that of the above illustrated embodiment but may be modified as needed as long as the mechanism is capable of varying the maximum lift amount of the engine valve. The variable lift amount mechanism is not restricted to a variable lift amount mechanism capable of continuously varying the lift amount but may be a variable lift amount mechanism that changes the lift amount in a stepped manner by at least two or more steps.

Although the lost motion mechanism 50 of the above illustrated embodiment includes the pivot type lash adjuster 40, the configuration of the lost motion mechanism is not restricted to that of the embodiment. For example, the lost motion mechanism may include a valve lifter. Alternatively, in an OHV type valve mechanism, for example, the lost motion mechanism may have a roller tappet. The present invention may also be employed in an SOHC type valve mechanism.

In the above illustrated embodiment, the lost motion mechanism 60 includes the lash adjuster 40, which automatically adjusts valve clearance of an engine valve through hydraulic pressure. However, the lost motion mechanism 60 may have a mechanical adjuster that adjusts valve clearance of an engine valve by manually changing the fastening amount of a thread.

In the above illustrated embodiment, to minimize the size of the lost motion mechanism 50, it is preferable that the maximum contraction amount X of the lost motion mechanism 50 be set to a value that absorbs the minimum value of the maximum lift amount Lmax of the engine valve 30. However, the present invention is not restricted to this. The maximum contraction amount of the lost motion mechanism may be set to a value that absorbs a predetermined lift amount smaller than the maximum value of the maximum lift amount of the engine valve and greater than the aforementioned minimum value. In this case, to perform cylinder deactivation, the maximum lift amount of the engine valve may be controlled to a value smaller than or equal to the aforementioned predetermined lift amount.

DESCRIPTION OF THE REFERENCE NUMERALS

1 . . . camshaft, 2 . . . cam, 2*a* . . . base circle, 2*b* . . . cam nose, 4 . . . cylinder head, 8 . . . oil pump, 10 . . . variable lift amount mechanism, 11 . . . support pipe, 12 . . . control shaft, 13 . . . input portion, 13*a* . . . input arm, 13*b* . . . roller, 13*c* . . . projecting piece, 14 . . . output portion, 14*a* . . . output arm, 15 . . . spring, 20 . . . roller rocker arm, 21 . . . roller, 30 . . . engine valve, 30*a* . . . stem portion, 31 . . . retainer, 32 . . . valve spring, 40 . . . lash adjuster, 41 . . . body, 41*b* . . . inlet hole, 41*c* . . . first chamber, 41*d* . . . insertion hole, 41*e* . . . projection, 41*f* . . . communication hole, 42 . . . plunger, 42*a* . . . communication hole, 42*b* . . . inlet hole, 42*c* . . . second chamber, 43 . . . plunger spring, 44 . . . ball retainer, 45 . . . ball spring, 46 . . . check ball, 48 . . . first supply passage, 50, 150 . . . lost motion mechanism, 51, 151 . . . housing, 51*a* . . . engagement hole, 51*b* . . . outlet hole, 52, 152 . . . lost motion spring, 53 . . . lack spring (urging member), 54 . . . lock pin (engagement member), 54*a* . . . recess, 54*b* . . . stepped portion, 58 . . . second supply passage, 59 . . . switch valve (switch portion), 60 . . . electronic control unit, 61 . . . control section

The invention claimed is:

1. A valve mechanism for an internal combustion engine, comprising:

a cam that rotates in conjunction with rotation of an engine output shaft;

an engine valve that is lifted and opened through rotation of the cam;

a variable lift amount mechanism arranged between the cam and the engine valve to vary a maximum lift amount of the engine valve; and a lost motion mechanism, wherein the lost motion mechanism absorbs a lift amount of the engine valve to maintain the engine valve in a closed state, wherein the lost motion mechanism includes a hydraulic lash adjuster arranged between the cam and the engine valve to automatically adjust a valve clearance of the engine valve, an urging member capable of contracting when the lash adjuster receives drive force from the cam, and a switch portion for switching an operation state of the lost motion mechanism between a permitting state for permitting contraction of the urging member and a prohibiting state for prohibiting the contraction, wherein the switch portion switches the operation state of the lost motion mechanism to the permitting state when the lost motion mechanism maintains the engine valve in the closed state, and a maximum contraction amount of the lost motion mechanism at the time when the lost motion mechanism is switched to the permitting state by the switch portion is set to such a value that the lost motion mechanism absorbs a predetermined lift amount that is smaller than a maximum value of the maximum lift amount of the engine valve.

2. The valve mechanism for an internal combustion engine according to claim 1, wherein the predetermined lift amount is set to a minimum value of the maximum lift amount of the engine valve.

3. The valve mechanism for an internal combustion engine according to claim 1, wherein the lost motion mechanism includes:

a housing shaped like a cylinder having a closed end, the housing accommodating the lash adjuster in a slidable manner;

an engagement member capable of engaging the housing and the lash adjuster with each other; and a supply passage that applies hydraulic pressure to the engagement member such that the hydraulic pressure acts on the engagement member in a direction for cancelling an engagement state between the housing and the lash adjuster, wherein the switch portion is a switch valve provided in the supply passage to switch supply modes of the hydraulic pressure to the engagement member.

4. A control device for controlling the valve mechanism for an internal combustion engine according to claim 1, the control device comprising a control section that controls the maximum lift amount of the engine valve to a value smaller than or equal to the predetermined lift amount when cylinder deactivation is performed in the internal combustion engine.

* * * * *